US008579214B2

(12) United States Patent
Headland

(10) Patent No.: US 8,579,214 B2
(45) Date of Patent: Nov. 12, 2013

(54) SWIRLER VANE

(75) Inventor: Paul Headland, Lincoln (GB)

(73) Assignee: Siemens Aktiengesellschaft, München (DE)

( * ) Notice: Subject to any disclaimer, the term of this patent is extended or adjusted under 35 U.S.C. 154(b) by 740 days.

(21) Appl. No.: 12/564,392

(22) Filed: Sep. 22, 2009

(65) Prior Publication Data

US 2010/0074757 A1 Mar. 25, 2010

(30) Foreign Application Priority Data

Sep. 25, 2008 (EP) ..... 08016911

(51) Int. Cl.
*B05B 7/10* (2006.01)

(52) U.S. Cl.
USPC ..... 239/494; 239/399; 239/463

(58) Field of Classification Search
USPC ..... 239/463, 466, 467, 468, 469, 470, 472, 239/474, 475, 483, 489, 490, 491–497, 500, 239/501, 502, 399–406
See application file for complete search history.

(56) References Cited

U.S. PATENT DOCUMENTS 713,670 A * 11/1902 Ocumpaugh ..... 239/472
3,605,407 A 9/1971 Bryce

FOREIGN PATENT DOCUMENTS

| | | |
|---|---|---|
| EP | 1821035 A1 | 8/2007 |
| GB | 2435508 A | 8/2007 |
| GB | 2444737 A | 6/2008 |

* cited by examiner

*Primary Examiner* — Christopher Kim

(57) ABSTRACT

A vane used on a swirler is provided. The vane includes a thin end and a broad end, the broad end has sharp edges and is arranged on the outside of the swirler, the thin end is arranged on the inside of the swirler. The vane also includes at least one swirl slot side profile, the at least one swirl slot side profile includes a unit providing turbulence to an air flow.

1 Claim, 4 Drawing Sheets

SWIRLER VANE

CROSS REFERENCE TO RELATED APPLICATIONS

This application claims priority of European Patent Office application No. 08016911.3 EP filed Sep. 25, 2008, which is incorporated by reference herein in its entirety.

FIELD OF INVENTION

The present invention relates to a swirler vane for use on a swirler.

BACKGROUND OF INVENTION

There are many environmental concerns associated with the emission of pollutants from gas turbine engines. This has led to stricter emissions standards to regulate and reduce the exhaust gas levels of pollutants from gas turbine engines. These standards regulate the emission of oxides of nitrogen (NOx), unburned hydrocarbons and smoke, and carbon monoxide (CO) from the engines of aircrafts.

Effectively, to control the emission of pollutants, the fuel and air must be well mixed so that burning occurs evenly across the mixture.

Mixing of fuel and air is achieved by the use of swirlers with the combustor. The swirler comprises a plurality of vanes arranged in a circular geometry. The vanes define flow slots between adjacent vanes. The flow slots provide passage for flow of fuel and air. Fuel is supplied by means of fuel injectors usually located on the flow paths. The swirler mixes swirlly the incoming air and the injected fuel.

SUMMARY OF INVENTION

It is an object of the invention to enhance mixing of fuel and air.

The above object is achieved by a vane for use on a swirler, the vane comprising a broad end and a thin end, said broad end defining sharp edges and arranged outwardly on said swirler, said thin end arranged inwardly on said swirler, said vane comprising at least one swirl slot side profile.

Thereby, reduction of emissions is achieved by the increasing level of fuel and air premix by providing improved aerodynamics for the swirler geometry and better target of fuel injection points.

According to a preferred embodiment of the invention, the vane further comprises means for providing turbulence to an air flow. This increases the turbulence intensity of the air flow and thus, enhances mixing of fuel and air.

According to a further preferred embodiment of the invention, the means for providing turbulence includes contours on surfaces of said swirl slot side profile.

According to yet another embodiment of the invention, the means for providing turbulence includes ribs on the surfaces of said swirl slot side profile. Thus, providing contours or ribs on the surfaces of the swirl slot side profile trips the air flow making local eddies to aid the fuel air mixture.

According to yet another embodiment of the invention, the at least one swirl slot side profile includes means for fuel injection. Thereby, improved emission control is achieved.

According to yet another embodiment of the invention, the at least one swirl slot side profile is of a cross section selected from the group consisting of a tubular profile, a rectangular profile, a converging rectangular profile, a diverging rectangular profile, a tapered converging rectangular profile, and a ribbed rectangular profile. This facilitates improved dynamics control and an increased engine turndown control.

BRIEF DESCRIPTION OF THE DRAWINGS

The present invention is further described hereinafter with reference to illustrated embodiments shown in the accompanying drawings, in which.

DETAILED DESCRIPTION OF INVENTION

Figure 1:
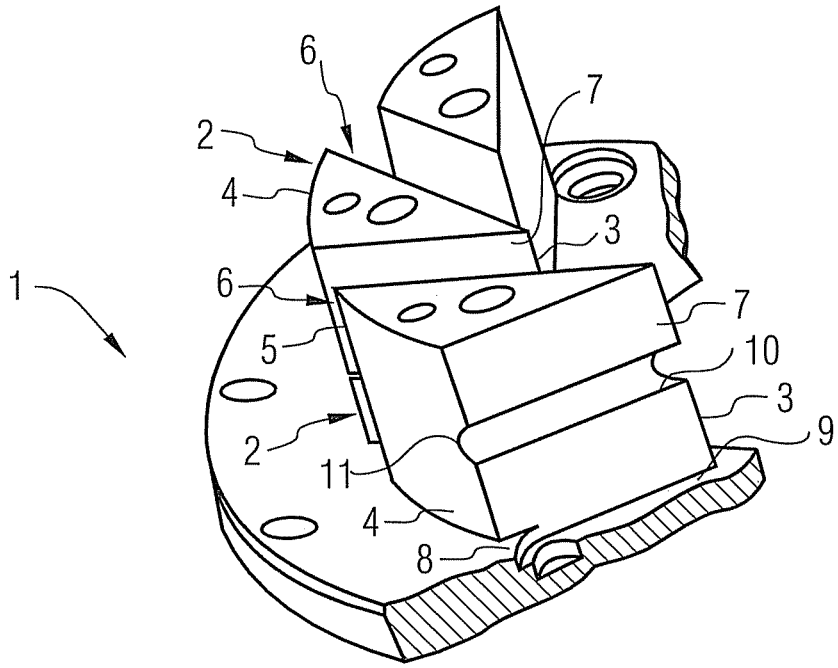
FIG. 1 illustrates a vane comprising a swirler slot side profile having a tubular cross section in accordance with an embodiment herein.

Referring to FIG. 1, a swirler 1 comprises a plurality of wedge shaped vanes 2 arranged radially. The vanes 2 comprise a thin end 3 and a broad end 4. The thin ends 3 are arranged inwardly and the broad ends 4 are arranged outwardly on the swirler 1. The broad end 4 of the vanes 2 generally comprises sharp edges 5. The vanes 2 define flow slots 6 between side walls 7 of adjacent vanes 2 arranged radially on the swirler 1. Each flow slot 6 has an inlet 8 and an outlet 9. Air enters the flow slot 6 at the inlet 8 and travel towards the outlet 9.

In an embodiment, a vane 2 comprises a swirl slot side profile 10. The swirl slot side profile 10 comprises a tubular cross section according to an embodiment herein. Further, the swirl slot side profile 10 comprises means for fuel injection such that the fuel is injected into the profile 10 via a fuel injection point 11. The air-fuel mix travels along the flow slot 6 and enters a central space (not shown) on the swirler 1 via the outlet 9, to form a swirling air-fuel mix. The central space on the swirler 1 is defined by the radially arranged vanes 2. The swirling air-fuel mix is then provided to a combustion chamber where it is combusted.

The sharp edges defined by the broad ends 4 tend to generate flow vertices that extend vertically upwards of the flow slot 6. The introduction of swirl slot side profile 10 is to distribute flow vertices along the flow slot 6 extending from swirl slot profile 10.

Thus, the swirl slot side profile 10 enables further reduction of emissions by providing improved aerodynamics for the swirler 1 geometry and better targeting of the fuel injection points 11 so that an increasing level of air and fuel premix is achieved. As a result of enhanced mixing, combustion is improved.

Figure 2:
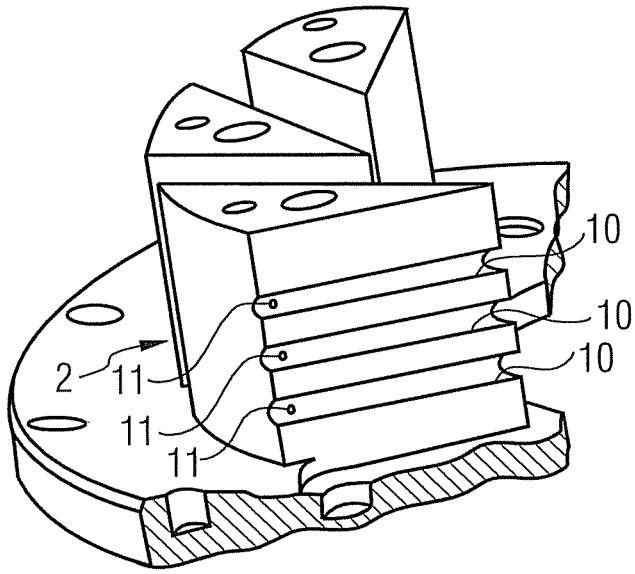
FIG. 2 illustrates a vane comprising swirler slot side profiles having tubular cross sections in accordance with an embodiment herein.

In FIG. 2, there is shown another embodiment of the invention. According to the present embodiment, the vane 2 comprises three swirl slot side profiles 10, which are tubular in cross section. Each swirl slot side profile 10 comprises a fuel injection point 11, through which the fuel may be injected.

In an alternative embodiment, any number of profiles 10 may be cut on the side of a slot 6, wherein the diameter of the profiles may be same or different. Further, separate fuel injection points 11 may be provided on each profile 10.

Figure 3:
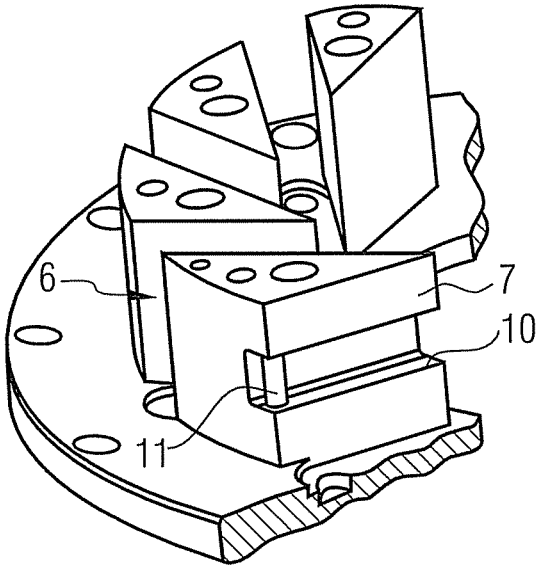
FIG. 3 illustrates a vane comprising a swirler slot side profile having a rectangular cross section in accordance with an embodiment herein.

FIG. 3 illustrates yet another embodiment of the invention. The swirl slot side profile 10 comprises a rectangular cross section. In an alternative embodiment, multiple profiles 10 may be cut on the side wall 7 of the flow slot 6, each with separate fuel injection points 11 if required.

Figure 4:
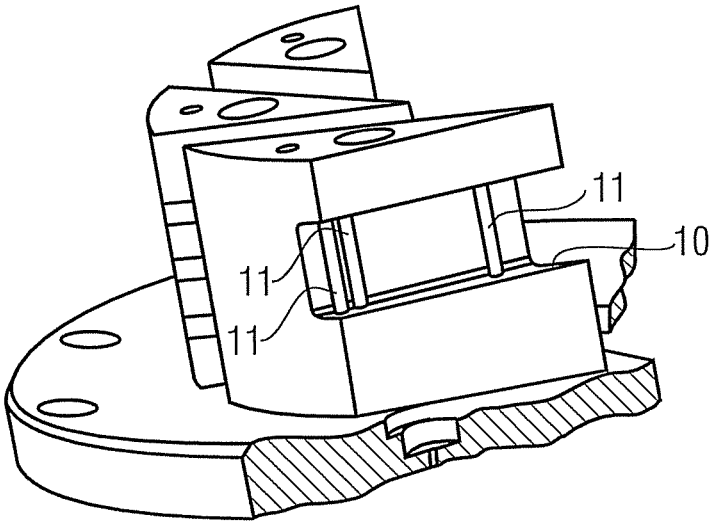
FIG. 4 illustrates a vane comprising a swirler slot side profile having a rectangular cross section with multiple fuel injection points in accordance with an embodiment herein.

FIG. 4 illustrates yet another embodiment of the invention. According to the present embodiment, the swirl slot side profile 10, shown in FIG. 3, comprises multiple fuel injection points 11. Multiple fuel injection points 11 may be provided on a swirl slot side profile 10 depending on the increasing level of fuel-air mixture desired.

Figure 5:
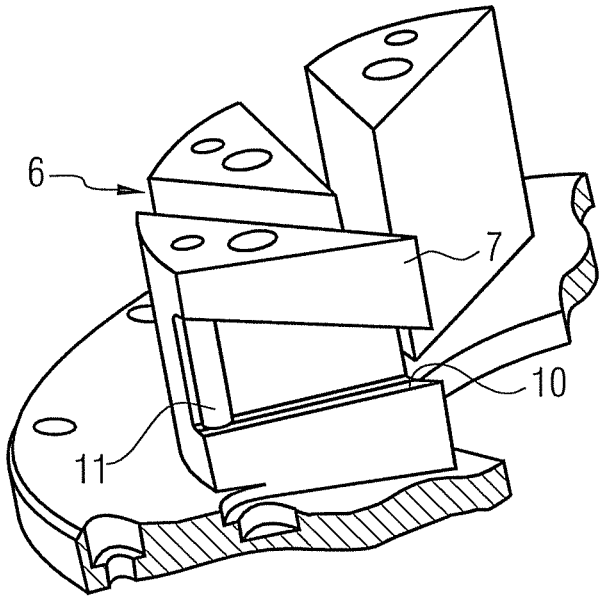
FIG. 5 illustrates a vane comprising a swirler slot side profile having a converging rectangular cross section in accordance with an embodiment herein.
Figure 6:
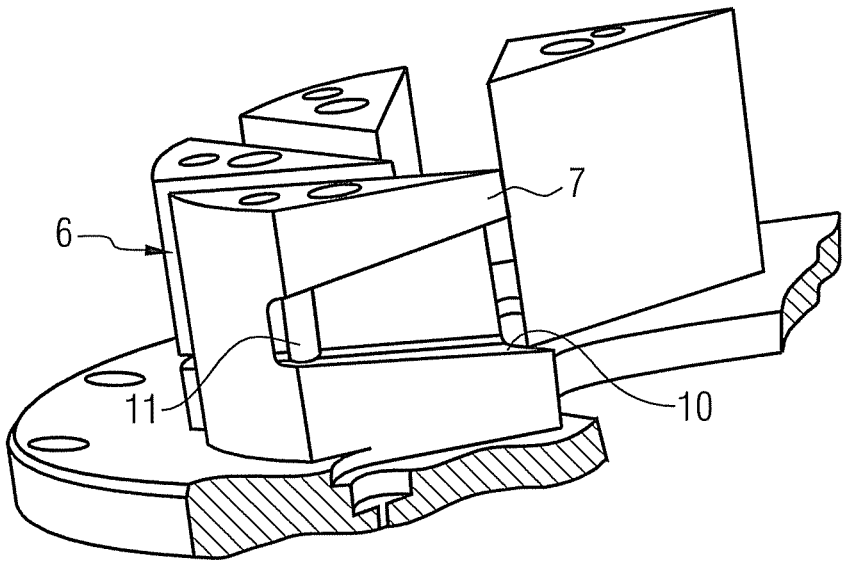
FIG. 6 illustrates a vane comprising a swirler slot side profile having a diverging rectangular cross section in accordance with an embodiment herein.

FIG. 5 and FIG. 6 illustrate further embodiments of the invention. In FIG. 5, it is shown that the swirl slot side profile 10 is of a converging rectangular cross section with a single fuel injection point 11 and in FIG. 6, it is shown that the swirl slot side profile 10 is of a diverging rectangular cross section with a single fuel injection point 11.

In an alternative embodiment, multiple converging or diverging profiles 10 may be cut on the side wall 7 of the flow slot 6, each with separate fuel injection points 11 depending on the increasing level of fuel-air mixture desired. Further, the cross section of the swirl slot side profile 10 may be varied to further enhance the fuel-air mixing.

Figure 7:
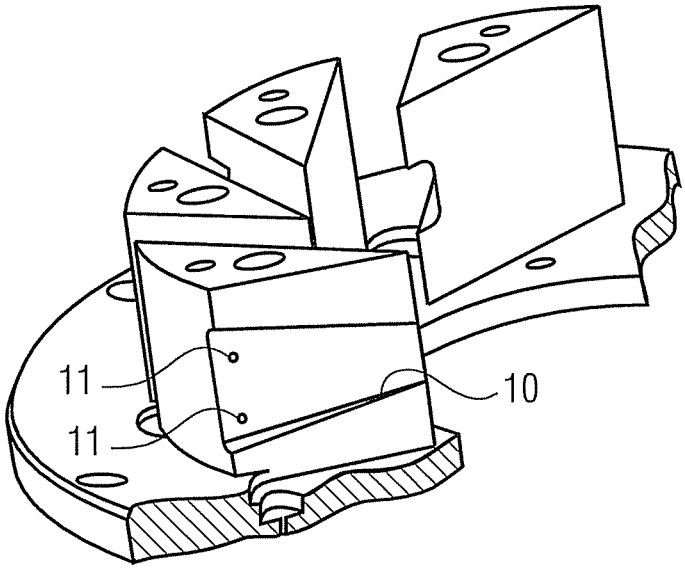
FIG. 7 illustrates a vane comprising a swirler slot side profile having a tapered converging rectangular cross section in accordance with an embodiment herein.

FIG. 7 illustrates yet another embodiment of the invention. The swirl slot side profile 10 comprises a tapered converging rectangular cross section with two fuel injection points 11. In an alternative embodiment, multiple fuel injection points may be provided on the profile 10 and the tapering angle may be varied to enhance the fuel-air mixing.

Figure 8:
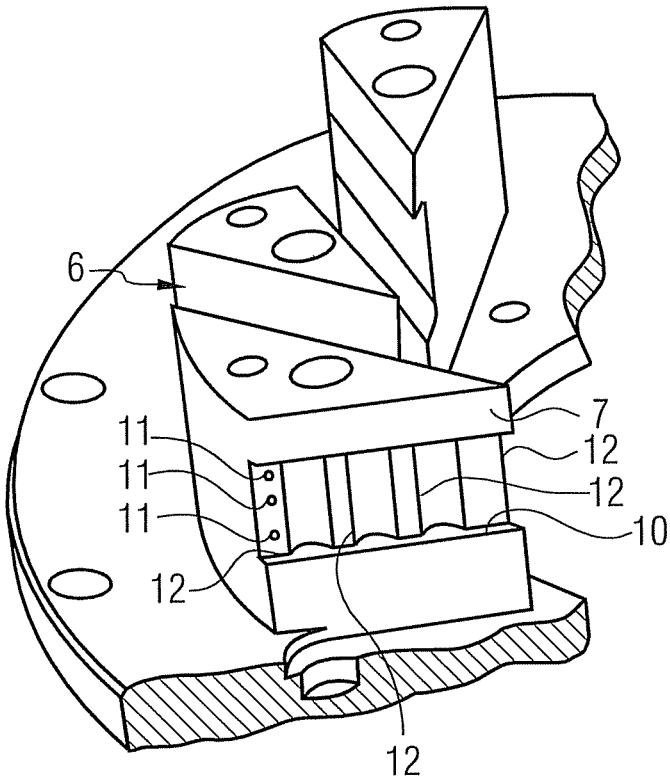
FIG. 8 illustrates a vane comprising a swirler slot side profile having a ribbed rectangular cross section in accordance with an embodiment herein, Various embodiments are described with reference to the drawings, wherein like reference numerals are used to refer to like elements throughout. In the following description, for purpose of explanation, numerous specific details are set forth in order to provide a thorough understanding of one or more embodiments. It may be evident that such embodiments may be practiced without these specific details.

FIG. 8 illustrates yet another embodiment of the invention. The swirl slot side profile 10 comprises a ribbed rectangular cross section with three fuel injection points 11. Ribs 12 are intended to trip the air flow making local eddies and increasing turbulence intensity and thus, enhance mixing between fuel and air. As a result of enhanced mixing, combustion is improved.

In an alternative embodiment, multiple swirl slot side profiles 10 of varying diameter may be cut on the side wall 7 of the flow slot 6 each with separate fuel injection points 11 depending on the requirement. Further, the cross section of the swirl slot side profiles 10 may be varied to enhance the fuel-air mixing. According to yet another embodiment, turbulence may be increased by providing contours on surfaces of the swirl slot side profile 10.

Thus, in accordance with the embodiments described above, the number of swirl slot side profiles 10 cut on a side wall 7 of a flow slot 6 may vary within wide ambits. Further, the swirl slot side profiles 10 may comprise any desired cross section depending on the increasing level of fuel-air mixing desired.

While this invention has been described in detail with reference to certain preferred embodiments, it should be appreciated that the present invention is not limited to those precise embodiments. Rather, in view of the present disclosure which describes the current best mode for practicing the invention, many modifications and variations would present themselves, to those of skill in the art without departing from the scope and spirit of this invention. The scope of the invention is, therefore, indicated by the following claims rather than by the foregoing description. All changes, modifications, and variations coming within the meaning and range of equivalency of the claims are to be considered within their scope.

The invention claimed is:

1. A swirler, comprising:

a plurality of vanes, each vane comprising:

a thin end;

a broad end; and a plurality of swirl slot side profiles cut on a side of a flow slot wherein the flow slot is defined between a side wall of adjacent vanes such that each flow slot includes an inlet and an outlet whereby air enters the flow slot at the inlet and travels toward the outlet, wherein the broad end of each vane includes sharp edges and is arranged on an outside of the swirler, wherein the thin end of each vane is arranged on an inside of the swirler, wherein each swirl slot side profile provides a turbulence to an air flow, and wherein a surface of each swirl slot side profile includes a contour which provides the turbulence, wherein each swirl slot side profile includes a cross section of a tubular profile, and wherein each swirl slot side profile includes a fuel injection point through which fuel is injected.

* * * * *